US006939667B2

(12) United States Patent
Taima

(10) Patent No.: US 6,939,667 B2
(45) Date of Patent: Sep. 6, 2005

(54) PHOTOSENSITIVE EMULSION AND PHOTOTHERMOGRAPHIC MATERIAL BY USE THEREOF

(75) Inventor: Yasuo Taima, Chofu (JP)

(73) Assignee: Konica Minolta Medical & Graphic, Inc., Tokyo (JP)

( * ) Notice: Subject to any disclaimer, the term of this patent is extended or adjusted under 35 U.S.C. 154(b) by 0 days.

(21) Appl. No.: 10/870,137

(22) Filed: Jun. 17, 2004

(65) Prior Publication Data

US 2004/0265757 A1 Dec. 30, 2004

(30) Foreign Application Priority Data

Jun. 24, 2003 (JP) ..... 2003-179473

(51) Int. Cl.[7] ..... G03C 1/005; G03C 1/494

(52) U.S. Cl. ..... 430/567; 430/618; 430/619; 430/620

(58) Field of Search ..... 430/618, 619, 430/620, 567

(56) References Cited

U.S. PATENT DOCUMENTS 6,268,118 B1 * 7/2001 Iwasaki et al. ..... 430/619
6,426,181 B2 * 7/2002 Irving et al. ..... 430/619
6,458,519 B1 * 10/2002 Sampei ..... 430/531

FOREIGN PATENT DOCUMENTS

DE 28 19 855 11/1978
EP 1 306 720 A2 5/2003
FR 2 436 129 4/1980

* cited by examiner

*Primary Examiner*—Geraldine Letscher
(74) *Attorney, Agent, or Firm*—Lucas & Mercanti, LLP

(57) ABSTRACT

A photo sensitive emulsion disclosed, comprising an organic silver salt, a photosensitive silver halide and a dispersing medium, wherein the organic silver salt is comprised of at least a first organic silver salt grains and a second organic silver salt grains which are different in average grain size from each other. A photothermographic material containing is also disclosed.

9 Claims, No Drawings

PHOTOSENSITIVE EMULSION AND PHOTOTHERMOGRAPHIC MATERIAL BY USE THEREOF

FIELD OF THE INVENTION

The present invention relates to a photothermographic material comprising an organic silver salt, a photosensitive silver halide, a reducing agent and a binder.

BACKGROUND OF THE INVENTION

In the field of graphic arts and medical treatment, there have been concerns in processing of photographic film with respect to effluent produced from wet-processing of image forming materials, and recently, reduction of the processing effluent is strongly demanded in terms of environmental protection and space saving. There has been desired a photothermographic dry imaging material for photographic use, capable of forming distinct black images exhibiting high sharpness, enabling efficient exposure by means of a laser imager or a laser image setter.

Known as such a technique are silver salt photothermographic dry imaging materials forming photographic images through thermal processing, as described in U.S. Pat. Nos. 3,152,904 and 3,487,075 and Morgan "Dry Silver Photographic Materials" (Handbook of Imaging Materials, Marcel Dekker, Inc. page 48, 1991).

These photothermographic materials are comprised of a light-sensitive layer containing a light-sensitive silver halide and an organic silver salt which function as a photosensor and silver source, respectively and which are thermally developed at a temperature of 80 to 250° C. with the reducing agent to form images, without being further subjected to fixing. Accordingly, to achieve smooth supply of silver ions to silver halide and to prevent deterioration in transparency caused by light scattering, much effort has been put into improvements in the shape of organic silver salt grains which are capable of being suitably arranged in the light-sensitive layer and little adversely affected with light scattering.

However, to achieve the foregoing objects, an attempt to obtain fine grains by means of dispersion and/or pulverization with high energy using a dispersing machine often causes deterioration in silver halide grains or organic silver salt grains, resulting in problems such that fogging is increased and sensitivity is reduced, leading to deteriorated image quality. Therefore, there has been studied a technique of achieving enhanced sensitivity and a high image density without increasing the silver coverage and minimized fogging, as described in JP-A Nos. 2000-53682, 2000-122219, 2001-264921 and 2001-350237 (hereinafter, the term, JP-A refers to an examined Japanese Patent Application Publication).

SUMMARY OF THE INVENTION

Accordingly, it is an object of the present invention to provide a photothermographic material exhibiting enhanced sensitivity, minimized fogging, enhanced covering power (CP), and a high maximum density, and providing gradation superior in representation of details.

In one aspect the present invention is directed to a photosensitive emulsion comprising an organic silver salt, a photosensitive silver halide and a binder, wherein the organic silver salt is comprised of at least two groups of organic silver salt grains which differ in average grain size (equivalent circle diameter); in another aspect the present invention is directed to a photothermographic material comprising a transparent support having thereon at least one light-sensitive layer comprising a photosensitive emulsion as described above, a reducing agent and a binder; in another aspect the present invention is directed to an image forming method comprising exposing the foregoing photothermographic material to light using a laser scanning exposure machine.

DETAILED DESCRIPTION OF THE INVENTION

An organic silver salt used in this invention will be described. The organic silver salt of this invention is comprised of at least two groups of organic silver salt grains, that is, a first organic silver salt grains and a second organic silver salt grains, and the average grain size of the first organic silver salt grains is different for that of the second organic silver salt grains. Herein, the grain size refers to an equivalent circle diameter. It is preferred that the silver halide used in this invention is comprised of at least two groups of silver halide grains which are different in average grain size from each other. Herein, the grain size refers to an equivalent circle diameter. The foregoing organic silver salt is preferably comprised of a first group of organic silver salt grains having an average grain size of 0.1 to 0.5 $\mu$m and a second group of organic silver salt grains having an average grain size of 0.7 to 1.2 $\mu$m. In this invention, the grain size refers to an equivalent circle diameter, that is, a diameter of a circle equivalent to an area of the grain (or grain projected area) electron-microscopically observed.

The organic silver salt comprised of at least two grain groups differing in average grain size can be prepared, for example, by blending at least two kinds of organic silver salt grains which exhibit, prior to blending, different average grain sizes. The two kinds of organic silver salt grains may be blended in any blending ratio and one of the two kinds of organic silver salt grains preferably accounts for 10% to 90% by weight of total grains.

The organic silver salt used in this invention is preferably comprised of tabular organic silver salt grains having an aspect ratio of at least 3 and more preferably having a needle-form ratio of not less than 1.1 and less than 10.0 (still more preferably not less than 1.1 and less than 5.0) which is measured vertical to the major face.

Further, tabular organic silver salt grains having an aspect ratio of at least 3 preferably account for at least 60%, more preferably at least 70%, and still more preferably at least 80% by number. The tabular organic silver salt grain having an aspect ratio of 3 or more refers to an organic salt grain exhibiting a ratio of grain diameter to grain thickness, a so-called aspect ratio (also denoted as AR) of 3 or more, which is defined as below:

$$AR=\text{diameter}(\mu m)/\text{thickness}(\mu m)$$

in which the diameter is an equivalent circle diameter. The aspect ratio of the tabular organic silver salt grains is preferably within the range of 3 to 20, and more preferably 3 to 10. In the case of an aspect ratio of less than 3, the organic salt grains easily form closest packing and in the case of the aspect ratio being excessively high, organic silver salt grains are easily superposed and dispersed in a coating layer in the form of being brought into contact with each other, easily causing light scattering and leading to deterioration in transparency of the photothermographic material.

Tabular organic silver salt grains exhibiting a less shape anisotropy of two faces (major faces) having a maximum area which are substantially in parallel and face with each other, are preferred in terms of being suitable for packing in the light-sensitive layer. Specifically, the needle-form ratio is preferably not less than 1.1 and less than 10.0, and more preferably not less than 1.1 and less than 5.0.

The average needle-form ratio of the tabular organic silver salt particles used in this invention can be determined in the following manner. Thus, the maximum length (denoted as MX LNG) and minimum width (denoted as WIDTH) of the grain are measured for at least 1000 particles, the needle-form ratio, as defined below is determined for each particle and an average value thereof is determined for total measured particles:

Needle-form ratio=(MX LNG)/(WIDTH)

where the maximum length of the particle (MX LNG) refers to the maximum length of a straight line connecting two points with the particle and the minimum width of the particle (WIDTH) refers to the minimum spacing between two parallel lines which are in contact with the periphery of the particle.

The organic silver salts used in this invention are reducible silver source, and silver salts of organic acids or organic heteroacids are preferred and silver salts of long chain fatty acid (preferably having 10 to 30 carbon atom and more preferably 15 to 25 carbon atoms) or nitrogen containing heterocyclic compounds are more preferred. Specifically, organic or inorganic complexes, ligands of which have a total stability constant to a silver ion of 4.0 to 10.0 are preferred. Exemplary preferred complex salts are described in Research Disclosure 17029 and 29963, including organic acid salts (e.g., salts of gallic acid, oxalic acid, behenic acid, stearic acid, palmitic acid, lauric acid, etc.); carboxyalkylthiourea salts (e.g., 1-(3-carboxypropyl)thiourea, 1-(3-caroxypropyl)-3,3-dimethylthiourea, etc.); silver complexes of polymer reaction products of aldehyde with hydroxy-substituted aromatic carboxylic acid (e.g., aldehydes such as formaldehyde, acetaldehyde, butylaldehyde), hydroxy-substituted acids (e.g., salicylic acid, benzoic acid, 3,5-dihydroxybenzoic acid, 5,5-thiodisalicylic acid, silver salts or complexes of thiones (e.g., 3-(2-carboxyethyl)-4-hydroxymethyl-4-(thiazoline-2-thione and 3-carboxymethyl-4-thiazoline-2-thione), complexes of silver with nitrogen acid selected from imidazole, pyrazole, urazole, 1.2,4-thiazole, and 1H-tetrazole, 3-amino-5-benzylthio-1,2,4-triazole and benztriazole or salts thereof; silver salts of saccharin, 5-chlorosalicylaldoxime, etc.; and silver-salts of mercaptides. Of these organic silver salts, silver salts of fatty acids are preferred, and silver salts of behenic acid, arachidic acid and/or stearic acid are specifically preferred.

The organic silver salt can be obtained by mixing an aqueous-soluble silver compound with a compound capable of forming a complex. Normal precipitation, reverse precipitation, double jet precipitation and controlled double jet precipitation, as described in JP-A 9-127643 are preferably employed. For example, to an organic acid can be added an alkali metal hydroxide (e.g., sodium hydroxide, potassium hydroxide, etc.) to form an alkali metal salt soap of the organic acid (e.g., sodium behenate, sodium arachidinate, etc.), thereafter, the soap and silver nitrate are mixed to form organic silver salt crystals. In this invention, silver halide grains may be concurrently present. An organic silver salt dispersion containing a photosensitive silver halide is preferably prepared by mixing silver halide grains separately prepared in the process of preparing the foregoing organic silver salt crystals. Mixing after preparation of an organic acid alkali metal salt soap is specifically preferred. A series of the reaction steps described above needs to be carried out with stirring to make uniform the inside of the reaction vessel using an appropriate means.

In embodiment of this invention, photosensitive silver halide is contained preferably in an amount of 2% to 10% by weight (more preferably 3% to 8% by weight), based on silver. An amount of less than 2% by weight leads to insufficient photosensitive silver halide functioning as a photosensor, making it difficult to obtain an intended image density. An amount of more than 10% by weight often causes aggregation of silver halide grains, resulting in insufficient sensitivity and an increase of an image density after storage.

Although the organic silver salt crystals formed may not be washed to remove soluble salts, washing can be conducted by commonly known methods such as flotation separation or centrifugal separation. The organic silver salt crystals may be subjected to a drying process before being dispersed to remove water. Drying apparatuses usable in this invention are not specifically limited and almost all apparatuses known in the art are usable. Examples of drying apparatuses usable in this invention include a vacuum dryer, a freeze dryer, a hot air type box dryer, a flash dryer, spray dryer and a fluidized bed dryer. Of these, a fluidized bed dryer and a flash dryer are preferred in this invention. Drying may be carried out at least two times in terms of productivity and prevention of over-drying.

Next, the photosensitive silver halide used in this invention will be described. The photosensitive silver halide functions as a photosensor. The photosensitive silver halide used in this invention is preferably comprised of at least two groups of silver halide grains differing in average grain size (equivalent circle diameter), and more preferably comprised of a first group of silver halide grains having an average grain size (equivalent circle diameter) of 0.01 to 0.03 $\mu$m (more preferably, 0.03 to 0.04 $\mu$m) and a second group of silver halide grains having an average grain size (equivalent circle diameter) of 0.05 to 0.09 $\mu$m. The foregoing silver halide can be obtained, for example, by blending at least two silver halide grain emulsions differing in the average grain size. The two silver halide emulsions may be blended in any blending ratio, and one of the foregoing two groups of silver halide grains preferably accounts for 10% to 90% by weight of the total silver halide grains.

The respective groups of silver halide grains are each monodisperse. The expression, monodisperse means a degree of dispersion, as defined below, of 40% or less, preferably 30% or less, and more preferably 20% or less:

degree of dispersion={(standard deviation of grain size)/(average grain size)}×100

The shape of the silver halide grains is not specifically limited, and the proportion accounted for by the Miller index [100] face can be obtained based on T. Tani, J. Imaging Sci., 29, 165 (1985) in which adsorption dependency of a [111] face or a [100] face is utilized.

Further, tabular silver halide grains are also preferred. In the invention, the tabular grains are referred to as those having an aspect ratio (=r/h) of at least 3, in which r is a grain diameter ($\mu$m) and a square root of a grain projected area, and h is a grain thickness in the vertical direction. Tabular grains having an aspect ratio of 3 to 50 are specifically preferred. These tabular grains are described in, for example, U.S. Pat. Nos. 5,264,337, 5,314,798 and 5,320,958, and intended tabular grains can be readily prepared.

The halide composition of photosensitive silver halide used in this invention is not specifically limited and may be any one of silver chloride, silver chlorobromide, silver iodochlorobromide, silver bromide, silver iodobromide and silver iodide. The silver halide grains can be prepared according to the methods described in P. Glafkides, Chimie Physique Photographique (published by Paul Montel Corp., 19679; G. F. Duffin, Photographic Emulsion Chemistry (published by Focal Press, 1966); V. L. Zelikman et al., Making and Coating of Photographic Emulsion (published by Focal Press, 1964). Any one of acidic precipitation, neutral precipitation and ammoniacal precipitation is applicable and the reaction mode of aqueous soluble silver salt and halide salt includes single jet addition, double jet addition and a combination thereof. Specifically, preparation of silver halide grains with controlling the grain formation condition, so-called controlled double-jet precipitation is preferred.

Silver halide used in the invention preferably includes ions of metals belonging to Groups 6 to 11 of the Periodic Table. Preferred as the metals are W; Fe, Co, Ni, Cu, Ru, Rh, Pd, Re, Os, Ir, Pt and Au. These metals may be introduced into silver halide in the form of a complex. In the present invention, regarding the transition metal complexes, six-coordinate complexes represented by the following formula (Z) are preferred:

Formula (Z) $(ML_6)^m$ wherein M represents a transition metal selected from elements in Groups 6 to 11 of the Periodic Table; L represents a coordinating ligand; and m represents 0, 1-, 2-, 3- or 4-. Exemplary examples of the ligand represented by L include halides (fluoride, chloride, bromide, and iodide), cyanide, qyanato, thiocyanato, selenocyanato, tellurocyanato, azido and aquo, nitrosyl, thionitrosyl, etc., of which aquo, nitrosyl and thionitrosyl are preferred. When the aquo ligand is present, one or two ligands are preferably coordinated. L may be the same or different.

Exemplary examples of transition metal-coordinated complexes are shown below:

1: $[RhCl_6]^{3-}$
2: $[RuCl_6]^{3-}$
3: $[ReCl_6]^{3-}$
4: $[RuBr_6]^{3-}$
5: $[OsCl_6]^{3-}$
6: $[IrCl_6]^{4-}$
7: $[Ru(NO)Cl_5]^{2-}$
8: $[RuBr_4(H_2O)]^{2-}$
9: $[Ru(NO)(H_2O)Cl_4]^{-}$
10: $[RhCl_5(H_2O)]^{2-}$
11: $[Re(NO)Cl_5]^{2-}$
12: $[Re(NO)(CN)_5]^{2-}$
13: $[Re(NO)Cl(CN)_4]^{2-}$
14: $[Rh(NO)_2Cl_4]^{-}$
15: $[Rh(NO)(H_2O)Cl_4]^{-}$
16: $[Ru(NO)(CN)_5]^{2-}$
17: $[Fe(CN)_6]^{3-}$
18: $[Rh(NS)Cl_5]^{2-}$
19: $[Os(NO)Cl_5]^{2-}$
20: $[Cr(NO)Cl_5]^{2-}$
21: $[Re(NO)Cl_5]^{-}$
22: $[Os(NS)Cl_4(TeCN)]^{2-}$
23: $[Ru(NS)Cl_5]^{2-}$
24: $[Re(NS)Cl_4(SeCN)]^{2-}$
25: $[Os(NS)Cl(SCN)_4]^{2-}$
26: $[Ir(NO)Cl_5]^{2-}$;
27: $[Ir(NS)Cl_5]^{2-}$;
28: $[Fe(CN)_6]^{4-}$
29: $[Ru(CN)_6]^{3-}$
30: $[Ru(CN)_6]^{4-}$
31: $[Os(CN)_6]^{4-}$
32: $[Co(CN)_6]^{3-}$
33: $[Rh(CN)_6]^{3-}$
34: $[Ir(CN)_6]^{3-}$
35: $[Cr(CN)_6]^{3-}$
36: $[Re(CN)_6]^{3-}$

These metal ions, metal complexes and metal complex ions may be used singly or in combination thereof. The content of the metal ions, metal complexes and metal complex ions is usually $1\times10^{-9}$ to $1\times10^{-2}$ mol, and preferably $1\times10^{-8}$ to $1\times10^{-4}$ mol per mol of silver halide. Compounds, which provide these metal ions or complex ions, are preferably incorporated into silver halide grains through addition during the silver halide grain formation. These may be added during any preparation stage of the silver halide grains, that is, before or after nuclei formation, growth, physical ripening, and chemical ripening. However, these are preferably added at the stage of nuclei formation, growth, and physical ripening; furthermore, are preferably added at the stage of nuclei formation and growth; and are most preferably added at the stage of nuclei formation. These compounds may be added several times by dividing the added amount. Uniform content in the interior of a silver halide grain can be carried out. As disclosed in JP-A Nos. 63-29603, 2-306236, 3-167545, 4-76534, 6-110146, 5-273683, the metal can be distributively occluded in the interior of the grain.

These metal compounds can be dissolved in water or a suitable organic solvent (e.g., alcohols, ethers, glycols, ketones, esters, amides, etc.) and then added. Furthermore, there are methods in which, for example, an aqueous metal compound powder solution or an aqueous solution in which a metal compound is dissolved along with NaCl and KCl is added to a water-soluble silver salt solution during grain formation or to a water-soluble halide solution; when a silver salt solution and a halide solution are simultaneously added, a metal compound is added as a third solution to form silver halide grains, while simultaneously mixing three solutions; during grain formation, an aqueous solution comprising the necessary amount of a metal compound is placed in a reaction vessel; or during silver halide preparation, dissolution is carried out by the addition of other silver halide grains previously doped with metal ions or complex ions. Specifically, the preferred method is one in which an aqueous metal compound powder solution or an aqueous solution in which a metal compound is dissolved along with NaCl and KCl is added to a water-soluble halide solution. When the addition is carried out onto grain surfaces, an aqueous solution comprising the necessary amount of a metal compound can be placed in a reaction vessel immediately after grain formation, or during physical ripening or at the completion thereof or during chemical ripening.

Silver halide grain emulsions used in the invention may be desalted after the grain formation, using the methods known in the art, such as the noodle washing method and flocculation process.

Silver halide grains usable in this invention may be chemically sensitized. Examples of preferred chemical sensitization include commonly known sulfur sensitization, selenium sensitization and tellurium sensitization. Noble metal sensitization ans reduction sensitization are also applicable in this invention. The method and procedure of these chemical sensitizations are described in, for example, U.S. Pat. No. 4,036,650, British Patent No. 1,518,850, JP-A Nos. 51-2243051-78319 and 51-81124.

The photothermographic material of this invention include reducing agents. Examples of the reducing agents include polyphenol compounds described in U.S. Pat. Nos. 3,589,903 and 4,021,249, British patent No. 1,486,148; JP-A Nos. 51-51933, 50-36110, 50-116023 and 52-84727; JP-B No. 51-35727 (hereinafter, the term, JP-B means a published Japanese Patent); bisnaphthols described in U.S. Pat. No. 3,672,904, such as 2,2'-dihydroxy-1,1'-binaphthyl and 6,6'-dibromo-2,2'-dihydoxy-1,1'-binaphthyl; sulfonamidophenols and sulfonamidonaphthols described in U.S. Pat. No. 3,801,321, such as 4-benzenesulfonamidophenol, 2-benzenesulfonamidophenol, 2,6-dichloro-4-benzenesulfonamido-phthol and 4-benzenesulfonamidonaphththol. Preferred reducing agents are bisphenol compounds (specifically, hindered phenols linked with a branched alkylene chain).

Representative examples thereof are shown below but are not limited to these.

A-1

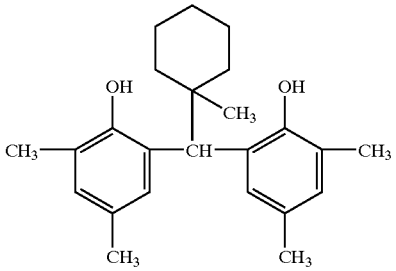

A-2

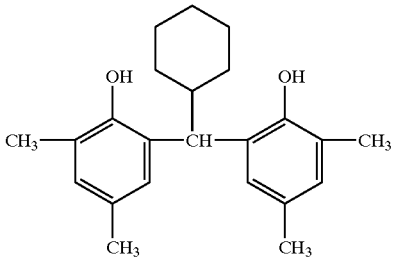

A-3

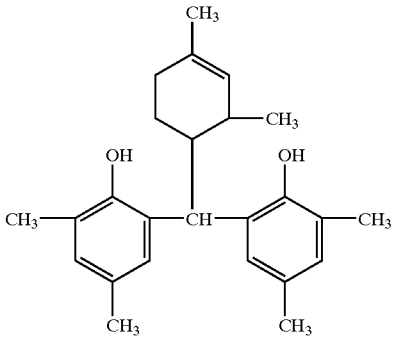

A-4

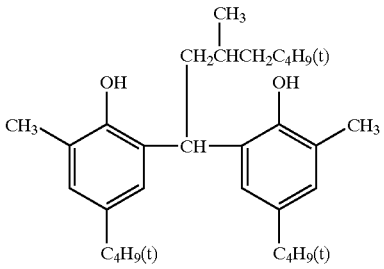

-continued

A-5

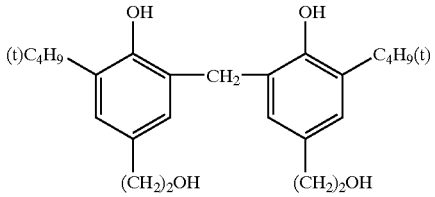

A-6

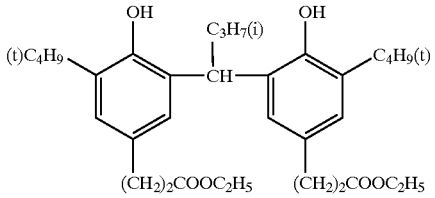

A-7

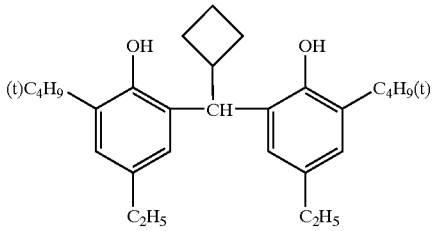

A-8

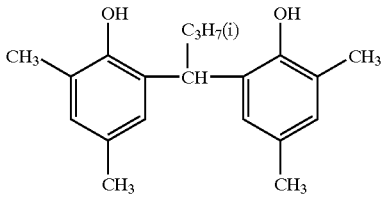

The amount of a reducing agent to be used, such as the compound represented by formula (A) is preferably $1\times10^{-2}$ to 10 mol and more preferably $1.5\times10^{-2}$ to 1.5 mol per mol silver.

The foregoing reducing agents can be used in combination with bisphenol derivatives represented by the following formula (A'). The combined use of the bisphenol compound of formula (A') with other reducing agents differing in chemical structure can unexpectedly prevent deterioration of performance caused by fogging during storage and deterioration of image color, caused during storage of thermally developed silver images.

formula (A')

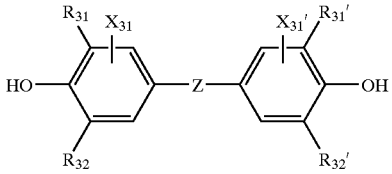

In the formula (A'), Z represents —S—or —C($R_{33}$)($R_{33}$')—, in which $R_{33}$ and $R_{33}$' each represents a hydrogen atom or a substituent. Examples of the substituent represented by $R_{33}$ and $R_{33}$' include an alkyl group (e.g., methyl, ethyl, propyl, isopropyl, butyl, isobutyl, sec-butyl, t-butyl), cycloalkyl group (e.g., cyclopropyl, cyclohexyl, 1-methylcyclohexyl), alkenyl group (e.g., vinyl, propenyl, butenyl, pentenyl, isohexenyl, butenylidene, isopentylidene), cycloalkenyl group (e.g., e.g., cyclohexenyl), alkynyl group (e.g., ethynyl, propynylidene), aryl group (e.g., phenyl, naphthyl), heterocyclic group (e.g., furyl, thienyl, pyridyl, tetrahydrofuranyl), halogen atom, hydroxyl, alkoxy group, aryloxy group, acyloxy group, sulfonyloxy group, nitro, amino group, acylamino group, sulfonylamino group, sulfonyl group, carboxy group, alkoxycarbonyl group, aryloxycarbonyl group, carbamoyl group, sulfamoyl group, cyano and sulfo. Of these, $R_{33}$ and $R_{33}'$ are each preferably a hydrogen atom, or an alkyl or cycloalkyl group, and it is more preferred that at least one of $R_{33}$ and $R_{33}'$ is a hydrogen atom and the other one is a hydrogen atom or an alkyl or cycloalkyl group.

$R_{31}$, $R_{32}$, $R_{31}'$ and $R_{32}'$ each represents a substituent. Substituents represented by $R_{31}$, $R_{32}$, $R_{31}'$ and $R_{32}'$ are the same as those described above for $R_{33}$ and $R_{33}'$. $R_{31}$, $R_{32}$, $R_{31}'$ and $R_{32}'$ are each preferably an alkyl group, alkenyl group, alkynyl group, cycloalkyl group, cycloalkenyl group, aryl group or heterocyclic group, and more preferably an alkyl or cycloalkyl group. The alkyl or cycloalkyl group may be substituted and substituents thereof are the same as described in $R_{33}$ and $R_{33}'$. It is still more preferred that at least one (preferably at least two) of $R_{31}$, $R_{32}$, $R_{31}'$ and $R_{32}'$ is a tertiary alkyl or cycloalkyl group, such as t-butyl, t-amyl, t-octyl or 1-methylcyclohexyl.

$X_{31}$ and $X_{31}'$ each represents a hydrogen atom or substituent. The substituent is the same as described in $R_{33}$ and $R_{33}'$.

Specific examples of the bisphenol compound represented by formula (A') are shown below but by no means limited to these.

A'-1

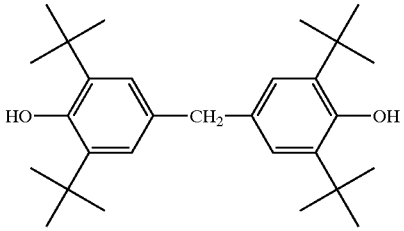

A'-2

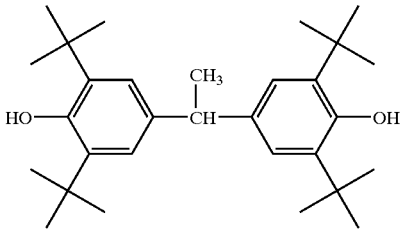

A'-3

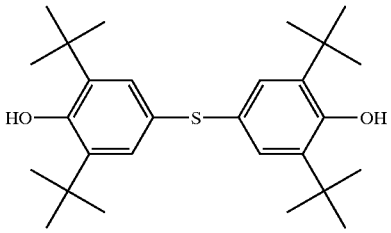

-continued

A'-4

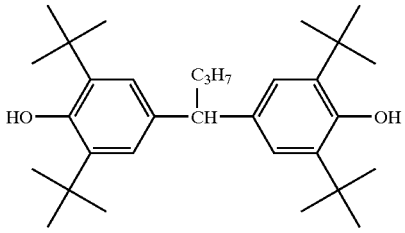

A'-5

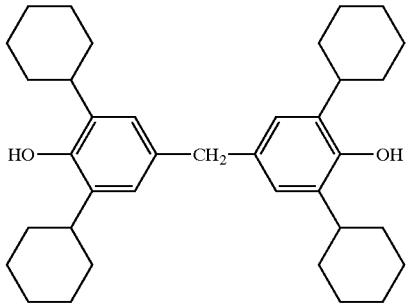

A'-6

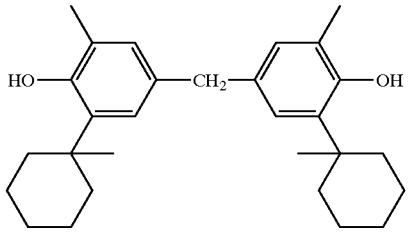

A'-7

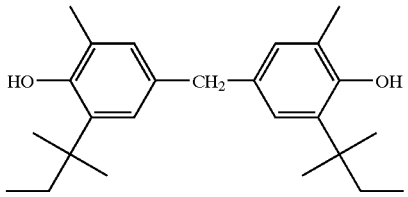

A'-8

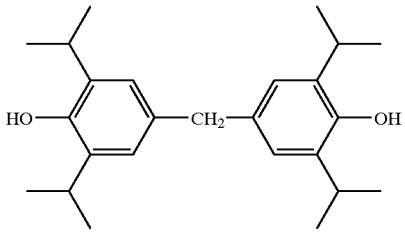

-continued

A'-9

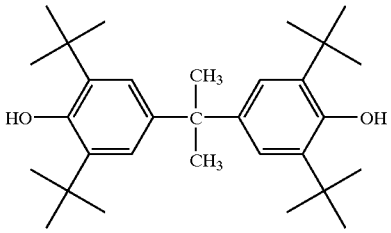

A'-10

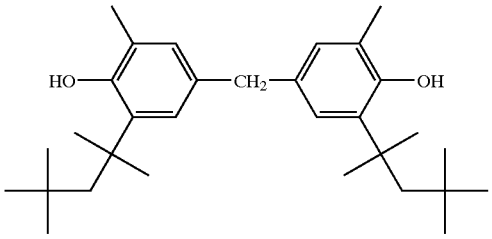

A'-11

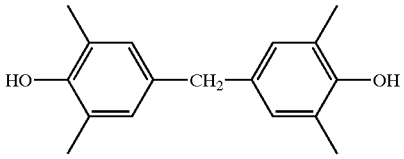

A'-12

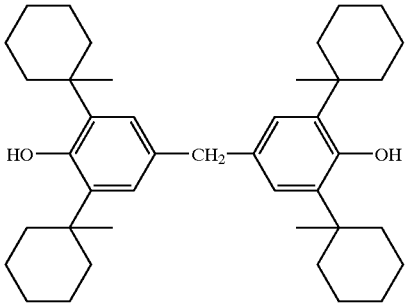

A'-13

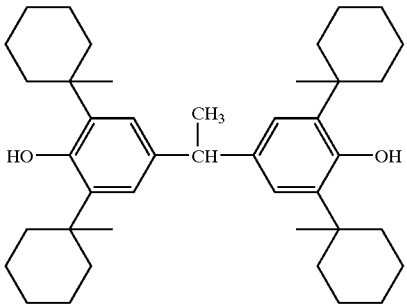

The compounds represented by the formula (A') are dispersed in water or dissolved in an organic solvent, and incorporated into a coating solution for the light-sensitive layer or a layer adjacent to the light-sensitive layer. The organic solvent can optionally be selected from alcohols such as methanol and ethanol, ketones such as acetone and methyl ethyl ketone and aromatic solvents such as toluene and xylene.

The compound represented by the formula (A') is used preferably in an amount of $1\times10^{-2}$ to 10 mol, and more preferably $1\times10^{-2}$ to 1.5 mol per mol of silver.

Antifoggants may be incorporated into the photothermographic material. Mercury ions are known as the most effective antifoggant. The incorporation of mercury compounds as the antifoggant into photosensitive materials is disclosed, for example, in U.S. Pat. No. 3,589,903. However, mercury compounds are not environmentally preferred. As mercury-free antifoggants are preferably those disclosed in U.S. Pat. Nos. 4,546,075 and 4,452,885, and JP-A No. 59-57234. Specifically preferred mercury-free antifoggants are heterocyclic compounds having at least one substituent, represented by —C($X^1$) ($X^2$) ($X^3$) (wherein X1 and X2 each represent halogen, and X3 represents hydrogen or halogen), as disclosed in U.S. Pat. Nos. 3,874,946 and 4,756,999. As examples of suitable antifoggants, employed preferably are compounds described in paragraph numbers [0030] through [0036] of JP-A No. 9-288328. Further, as another examples of suitable antifoggants, employed preferably are compounds described in paragraph numbers [0062] and [0063] of JP-A No. 9-90550. Furthermore, other suitable antifoggants are disclosed in U.S. Pat. No. 5,028,523, and European Patent No. 600,587 and 605,981 and 631,176.

The photothermographic material is preferably added with image toning agents to improve silver image color. Image toning agents are associated with Oxidation reduction reaction between an organic silver salt and a reducing agent, having a function of raise the silver image density or change it to black. Examples of preferred image toning agents are disclosed in Research Disclosure Item 17029, including imides (for example, phthalimide), cyclic imides, pyrazoline-5-one, and quinazolinone (for example, succinimide, 3-phenyl-2-pyrazoline-5-on, 1-phenylurazole, quinazoline and 2,4-thiazolidione); naphthalimides (for example, N-hydroxy-1,8-naphthalimide); cobalt complexes (for example, cobalt hexaminetrifluoroacetate), mercaptans (for example, 3-mercapto-1,2,4-triazole); N-(aminomethyl) aryldicarboxyimides (for example, N-(dimethylaminomethyl)phthalimide); blocked pyrazoles, isothiuronium derivatives and combinations of certain types of light-bleaching agents (for example, combination of N,N'-hexamethylene(1-carbamoyl-3,5-dimethylpyrazole), 1,8-(3,6-dioxaoctane)bis-(isothiuroniumtrifluoroacetate), and 2-(tribromomethyl-sulfonyl)benzothiazole; merocyanine dyes (for example, 3-ethyl-5-((3-etyl-2-benzothiazolinylidene-(benzothiazolinylidene))-1-methylethylidene-2-thio-2,4-oxazolidinedione); phthalazinone, phthalazinone derivatives or metal salts thereof (for example, 4-(1-naphthyl)phthalazinone, 6-chlorophthalazinone, 5,7-dimethylphthalazinone, and 2,3-dihydro-1,4-phthalazinedione); combinations of phthalazinone and sulfinic acid derivatives (for example, 6-chlorophthalazinone and benzenesulfinic acid sodium, or 8-methylphthalazinone and p-trisulfonic acid sodium); combinations of phthalazine and phthalic acid; combinations of phthalazine (including phthalazine addition products) with at least one compound selected from maleic acid anhydride, and phthalic acid, 2,3-naphthalenedicarboxylic acid or o-phenylenic acid derivatives and anhydrides thereof (for example, phthalic acid, 4-methylphthalic acid, 4-nitrophthalic acid, and tetrachlorophthalic acid anhydride); quinazolinediones, benzoxazine, naphthoxazine derivatives, benzoxazine-2,4-diones (for example, 1,3-benzoxazine-2,4-dione); pyrimidines and asymmetry-triazines (for example, 2,4-dihydroxypyrimidine), and tetrazapentalene derivatives (for example, 3,6-dimercapto-1,4-diphenyl-1H,4H-2,3a,-5,6a-tetrazapentalene). Preferred image color control agents include phthalazone or phthalazine. Of these image toning agents, phthalazone and phthalazine are preferred.

In the Photothermographic material are usable spectral sensitizing dyes described in JP-A Nos. 63-159841, 60-140335, 64-231437, 63-259651, 63-304242, 63-15245; U.S. Pat. Nos. 4,639,414, 4,740,455, 4,741,966, 4,751,175 and 4,835,096. Useful sensitizing dyes used in this invention include, for example, those described in Research Disclosure 17643, sect. IV-A (December 1978, page 23) and ibid 18431 (August 1979, page 437). There can be advantageously chosen sensitizing dyes exhibiting spectral sensitivity suitable for spectral characteristics of various scanning light sources. For example, compounds described in JP-A Nos. 9-34078, 9-54409 and 9-80679 are preferably used.

Sensitizing dyes may be used alone or in combination of at least two of them. When sensitizing dyes are used alone or in combination, the dyes are contained in a silver halide emulsion preferably in a total amount of $1\times10^{-6}$ to $1\times10^{-3}$ mol, more preferably $1\times10^{-5}$ to $2.5\times10^{-3}$ mol, and still more preferably $4\times10^{-5}$ to $1\times10^{-3}$ mol per mol of silver halide. Two or more sensitizing dyes are used in combination in any ratio thereof. The combination of sensitizing dyes is often employed for the purpose of supersensitization. A dye having no function of spectral sensitization or a substance having no visible absorption, which achieves supersensitization may be incorporated into the emulsion.

To restrain or accelerate development for the purpose of controlling the development, to enhance the spectral sensitive efficiency, or to enhance the reservation stability before and after the development, a mercapto compound, a disulfide compound and a thione compound can be incorporated in the photosensitive material. In cases where the mercapto compound is used in the present invention, any compound having a mercapto group can be used, but preferred compounds are represented by the following formulas, Ar—SM and Ar—S—S—Ar, wherein M represents a hydrogen atom or an alkaline metal atom, Ar represents an aromatic ring compound or a condensed aromatic ring compound having at least a nitrogen, sulfur, oxygen, selenium or tellurium. Preferable aromatic heterocyclic ring compounds include benzimidazole, naphthoimidazole, benzothiazole, naphthothiazole, benzoxazole, naphthooxazole, benzoselenazole, benzotellurazole, imidazole, oxazole, pyrazole, triazole, thiadiazole, tetrazole, triazine, pyrimidine, pyridazine, pyrazine, pyridine, purine, quinoline or quinazoline. These aromatic heterocyclic ring compounds may contain a substituent selected from a halogen atom (e.g., Br and Cl), a hydroxy group, an amino group, a carboxy group, an alkyl group (e.g., alkyl group having at least a carbon atom, preferably 1 to 4 carbon atoms) and an alkoxy group (e.g., alkoxy group having at least a carbon atom, preferably 1 to 4 carbon atoms). Examples of mercapto-substituted aromatic heterocyclic ring compounds include 2-mercaptobenzimidazole, 2-mercaptobenzoxazole, 2-mercaptobenzothiazole, 2-mercapto-5-methylbenzoimidazole, 6-ethoxy-2-mercaptobenzothiazole, 2,2'-dithiobisbenzothiazole, 3-mercaptol,2,4-triazole, 4,5-diphenyl-2-imidazolethio, 2-mercaptoimidazole, 1-ethyl-2-mercaptobenzimidazole, 3-mercapto-1,2,4-triazole, 2-mercaptoquinoline, 2-mercapto-4-(3H)quinazolinone, 7-trifluoromethyl-4-quinolinethiol, 2,3,5,6-tetrachloro-4-pyridinethiol, 4-amino-6-hydroxy-2-mercapto-1,3,4-thiadiazole, 3-amino-5-mercapto,12,4-triazole, 4-hydroxy-2-mercaptopyrimidine, 2-mercaptppyrimidine, 4,6-diamino-2-mercaptopyrimidine, 2-mercapto-4-methylpyrimidine hydrochloride, 3-mercapto-5-phenyl-1,2,4-triazole, and 2-mercapto-4-phenyloxazole, but the exemplified compounds according to the present invention are not limited thereto.

In the present invention, a matting agent is preferably incorporated into the image forming layer side. In order to minimize image abrasion after thermal development, a matting agent is provided on the surface of a photosensitive material and the matting agent is preferably incorporated in an amount of 0.5 to 10 percent in weight ratio with respect to the total binder in the emulsion layer side. When a light-insensitive layer is provided on the opposite side of a support to the light-sensitive layer, at least one layer provided on the light-insensitive layer side preferably contains a matting agent. It is also preferred to incorporate a matting agent onto the surface of the photothermographic material to enhance a sliding property or to prevent flaws. The content of a matting agent incorporated into the opposite layer side to the light-sensitive layer is preferably 0.5% to 40% by weight, based on total binder.

Materials of the matting agents employed in the present invention may be either organic substances or inorganic substances. Regarding inorganic substances, for example, those which can be employed as matting agents, are silica described in Swiss Patent No. 330,158, etc.; glass powder described in French Patent No. 1,296,995, etc.; and carbonates of alkali earth metals or cadmium, zinc, etc. described in British Patent No. 1,173,181, etc. Regarding organic substances, which can be employed as organic matting agents are starch described in U.S. Pat. No. 2,322,037, etc.; starch derivatives described in Belgian Patent No. 625,451, U.K. Patent No. 981,198, etc.; polyvinyl alcohols described in Japanese Patent Publication No. 44-3643, etc.; polystyrenes or polymethacrylates described in Swiss Patent No. 330,158, etc.; polyacrylonitriles described in U.S. Pat. No. 3,079,257; and polycarbonates described in U.S. Pat. No. 3,022,169.

The particle shape of the matting agent may be crystalline or amorphous. However, a crystalline and spherical shape is preferably employed. The particle size of the matting agent is expressed as the diameter of a sphere which has the same volume as the matting agent. The particle diameter of the matting agent in the present invention is referred to the diameter of a spherical converted volume. The matting agent employed in the present invention preferably has an average particle diameter of 0.5 to 10 $\mu$m, and more preferably of 1.0 to 8.0 $\mu$m. Furthermore, the variation coefficient of the size distribution is preferably not more than 50 percent, is more preferably not more than 40 percent, and is most preferably not more than 30 percent. The variation coefficient of the size distribution as described herein is a value represented by the formula described below:

Variation coefficient=(Standard deviation of particle diameter)/(average particle diameter)×100 The matting agent according to the present invention can be incorporated into any layer. In order to accomplish the object of the present invention, the matting agent is preferably incorporated into a layer other than the image forming layer, and is more preferably incorporated into the layer farthest from the support surface. Addition methods for the matting agent include those in which a matting agent is previously dispersed into a coating composition and is then coated, and prior to the completion of drying, a matting agent is sprayed onto the layer. When plural matting agents are added, both methods may be employed in combination.

Metal oxides and/or conductive polymers may be incorporated into at least one of component layers to improve an electrostatic property. These may be any of the component layers and preferably into a subbing layer, a backing layer or interlayer between the light-sensitive layer and subbing layer. Compounds described in U.S. Pat. No. 5,244,773, col. 14–20 are preferably used in this invention.

A variety of additives may be incorporated into any one of a light-sensitive layer, a light-insensitive layer and other component layers. There may be incorporated, for example, a surfactant, an antioxidant, a stabilizer, a plasticizer, a UV absorber and a coating aid. As these additives and other ones are usable compounds described in Research Disclosure 17029 (June, 1978, page 9–15).

Binders suitable for photothermographic materials are transparent or translucent and generally colorless, including natural polymers, synthetic polymers or copolymers and film forming mediums. Exemplary examples thereof include gelatin, gum Arabic, polyvinyl alcohol, hydroxyethyl cellulose, cellulose acetate, cellulose acetate butyrate, polyvinyl pyrrolidine, casein, starch, polyacrylic acid, poly (methyl methacrylate), poly(methylmethacrylic acid), polyvinyl chloride, polymethacrylic acid, copoly(styrene-anhydrous maleic acid), copoly(styrene-acrylonitrile), copoly(styrene-butadiene9, polyvinyl acetals (e.g., polyvinyl formal, polyvinyl butyral), polyesters, polyurethanes, phenoxy resin, polyvinylidene chloride, polyepoxides, polycarbonates, polyvinyl acetate, cellulose esters, and polyamides, which may be hydrophilic or hydrophobic. Of these binders, a water-insoluble polymer such as cellulose acetate, cellulose acetatebutyrate, and polyvinyl butyral are preferred and polyvinyl butyral is specifically preferred. To protect the surface of a photothermographic material and prevent abrasion marks, a light-insensitive layer may be provided on the outer side of the light-sensitive layer. Binders used in such a light-insensitive layer may be the same as or different from those used in the light-sensitive layer. To promote the thermal developing rate, a binder in contained in the light-sensitive layer preferably in an amount of 1.5 to 10 g/m$^2$, and more preferably 1.7 to 8 g/m$^2$. An amount of less than 1.5 g/m$^2$ causes a density of an unexposed area to be increased, often making it unacceptable to practice.

In order to minimize the deformation of images after development processing, supports employed in the present invention are preferably plastic films (for example, polyethylene terephthalate, polycarbonate, polyimide, nylon, cellulose triacetate, polyethylene naphthalate). Of these, listed as preferred supports, are polyethylene terephthalate (hereinafter referred to as PET) and other plastics (hereinafter referred to as SPS) comprising styrene series polymers having a syndiotactic structure. The thickness of the support is between about 50 and about 300 $\mu$m, and is preferably between 70 and 180 $\mu$m. Furthermore, thermally processed plastic supports may be employed. As acceptable plastics, those described above are listed. The thermal processing of the support, as described herein, is that after film casting and prior to the photosensitive layer coating, these supports are heated to a temperature at least 30° C. higher than the glass transition point, preferably by not less than 35° C. and more preferably by at least 40° C. PET is comprised of polyethylene terephthalate as a polyester constituent, in which a modifying polyester constituent comprising an acid component such as terephthalic acid, naphthalene-2,6-dicarboxylic acid, isophthalic acid, butylenedicarboxylic acid, sodium 5-sulfoisophthalate, or adipic acid and a glycol component such as ethylene glycol, propylene glycol, butanediol or cyclohexanedimethanol may be contained in an amount of not more than 10%, based on the whole polyester. SPS, which is different from conventional polystyrene (atactic postyrene), is a polystyrene having a steric regularity. In SPS, a sterically regular portion is called a racemo chain, in which more regular portion such as two-chain, three-chain, five-chain or higher chain is more preferred. The racemo chain is preferably comprised of at least 85% of the two-chain, at least 75% of the three-chain, at least 50% of the 5-chain or at least 30% of higher chain. Polymerization of SPS can be performed in accordance with the method described in JP-A No. 3-131843.

Film-making or subbing methods of supports used in the photothermographic material of this invention can be conducted by the method described in JP-A No. 9-50094, paragraph No. [0030] to [0070].

A photothermographic material of this invention, which forms photographic images on thermal development, is preferably comprised of a reducible silver source (organic silver salt), light-sensitive silver halide and a reducing agent, and optionally an image toning agent to improve silver image color which are dispersed in a binder matrix. Whereas the photothermographic material is stable at ordinary temperature, the exposed photothermographic material is developed on heating at a high temperature (e.g., 80 to 140° C.) to form silver through an oxidation and reduction reaction between an organic silver salt (functioning as an oxidizing agent) and a reducing agent. The oxidation reduction reaction can be promoted by the catalytic action of a latent image produced from silver halide exposed to light. Silvers formed by the reaction with an organic silver salt in exposed areas provide a black image, which is contrasted with unexposed areas forming no image. This reaction process proceeds without supplying a processing solution such as water from the outside.

The photothermographic material of this invention comprises at least one light-sensitive layer on a support. Only a light-sensitive layer may be provided on the support but at least one light-insensitive layer is preferably provided on the support. To control the quantity or the wavelength distribution of light passing through the light-sensitive layer, a filter layer may be provided on the same or opposite side to the light-sensitive layer or a dye or a pigment may be contained in the light-sensitive layer. Dyes described in JP-A No. 8-201959 are preferred. The light-sensitive layer may be comprised of plural layers or be divided to a high-sensitive layer and low-sensitive layer, or combined with each other. Various additives may be incorporated into any of a light-sensitive layer and a light-insensitive layer. There may be used in the photothermographic material a surfactant, an antioxidant, stabilizer, plasticizer, UV absorber and coating aid described earlier. The light-insensitive layer preferably contains a binder or a matting agent described above, and polysiloxane compound, or a lubricant such as a wax or a paraffin may further added thereto.

The photothermographic material of this invention preferably has a total silver coverage of 0.5 to 1.5 g/m$^2$. Photothermographic materials are detailed in U.S. Pat. Nos. 3,152,904 and 3,487,075, and Morgan "Dry Silver Photographic Materials" (Handbook of Imaging Materials, Marcel Dekker, Inc. page 48, 1991). In this invention, the photothermographic material is thermally developed at a temperature of 80 to 140° C. to form images without being fixed, so that silver halide and organic silver salt in unexposed areas remain there without being removed.

The photothermographic material that has been subjected to thermal development, preferably exhibits an optical transmission density at 400 nm of not more than 0.2, and more preferably 0.02 to 0.2 inclusive of a support. An optical transmission density of less than 0.02 is too low in sensitivity, which is unacceptable in practical use.

Examples of solvents include ketones such as acetone, isophorone, ethyl amyl ketone, methyl ethyl ketone, methyl isobutyl ketone; alcohols such as methyl alcohol, ethyl alcohol, n-propyl alcohol, isopropyl alcohol, n-butyl alcohol, isobutyl alcohol, diacetone alcohol, cyclohexanol, and benzyl alcohol; glycols such as ethylene glycol, dimethylene glycol, triethylene glycol, propylene glycol and hexylene glycol; ether alcohols such as ethylene glycol monomethyl ether, and dimethylene glycol monomethyl ether; ethers such as ethyl ether, dioxane, and isopropyl ether; esters such as ethyl acetate, butyl acetate, amyl acetate, and isopropyl acetate; hydrocarbons such as n-pentane, n-hexane, n-heptane, cyclohexene, benzene, toluene, xylene; chlorinated compounds such as chloromethyl, chloromethylene, chloroform, and dichlorobenzene; amines such as monomethylamine, dimethylamine, triethanol amine, ethylenediamine, and triethylamine; and water, formaldehyde, dimethylformaldehyde, nitromethane, pyridine, toluidine, tetrahydrofuran and acetic acid. The solvents are not to be construed as limited to these examples. These solvents may be used alone or in combination. The solvent content in the photosensitive material can be adjusted by varying conditions such as temperature conditions in the drying stage after the coating stage. The solvent content can be determined by means of gas chromatography under conditions suitable for detecting the solvent. The total solvent content of a photothermographic material used in the invention is preferably 5 to 1000 mg/m$^2$, and more preferably 10 to 300 mg/m$^2$. The solvent content within the range described above leads to a thermally developable photosensitive material with low fog density as well as high sensitivity.

It is also preferred to use a laser exposure apparatus, in which the scanning laser light is not exposed at an angle substantially vertical to the exposed surface of the photothermographic material. The expression "laser light is not exposed at an angle substantially vertical to the exposed surface" means that laser light is exposed preferably at an angle of 55 to 88°, more preferably 60 to 86°, still more preferably 65 to 84°, and optimally 70 to 82°. When the photothermographic material is scanned with laser light, the beam spot diameter on the surface of the photothermographic material is preferably not more than 200 μm, and more preferably not more than 100 μm. Thus, the less spot diameter preferably reduces the angle displaced from verticality of the laser incident angle. The lower limit of the beam spot diameter is 10 μm. The thus laser scanning exposure can reduce deterioration in image quality due to reflected light, such as occurrence of interference fringe-like unevenness.

Exposure applicable in this invention is conducted preferably using a laser scanning exposure apparatus producing longitudinally multiple scanning laser light, whereby deterioration in image quality such as occurrence of interference fringe-like unevenness is reduced, as compared to scanning laser light with a longitudinally single mode. Longitudinal multiplication can be achieved by a technique of employing backing light with composing waves or a technique of high frequency overlapping. The expression "longitudinally multiple" means that the exposure wavelength is not a single wavelength. The exposure wavelength distribution is usually not less than 5 nm and not more than 10 nm. The upper limit of the exposure wavelength distribution is not specifically limited but usually extends to 60 nm.

EXAMPLES

The present invention is further described in detail based on examples but embodiments of the invention are by no means limited to these. Unless otherwise noted, "%" in Examples means "% by weight (or weight %)".

Example 1

Preparation of a Subbed Support:

Both surfaces of a biaxially stretched thermally fixed 175 μm PET film, available on the market, was subjected to corona discharging at 8 w/m$^2$·min. Onto one side of the film, the subbing coating composition a-1 descried below was applied so as to form a dried layer thickness of 0.8 μm, which was then dried. The resulting coating was designated Subbing Layer A-1. Onto the opposite surface, the subbing coating composition b-1 described below was applied to form a dried layer thickness of 0.8 μm. The resulting coating was designated Subbing Layer B-1.

Blue dye

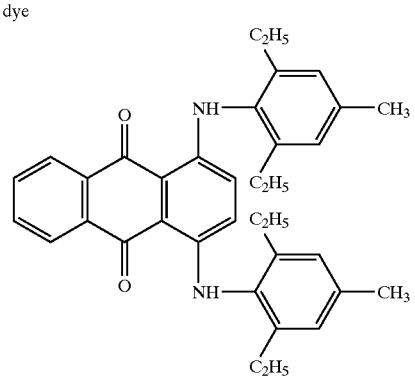

Subbing Coating Composition a-1:

| | |
|---|---|
| Latex solution (30 weight %) of a copolymer consisting of butyl acrylate (30 weight %)/t-butyl acrylate (20 weight %)/ styrene (25 weight %)/2-hydroxy ethyl acrylate (25 weight %) | 270 g |
| (C-1) | 0.6 g |
| Hexamethylene-1,6-bis(ethyleneurea) | 0.8 g |
| Water to make | 1 liter |

Subbing Coating Composition b-1:

| | |
|---|---|
| Latex liquid (solid portion of 30%) of a copolymer consisting of butyl acrylate (40 weight %) styrene (20 weight %) glycidyl acrylate (25 weight %) | 270 g |
| (C-1) | 0.6 g |
| Hexamethylene-1,6-bis (ethyleneurea) | 0.8 g |
| Water to make | 1 liter |

Subsequently, the surfaces of Subbing Layers A-1 and B-1 were subjected to corona discharging with 8 w/m$^2$·minute. Onto the Subbing Layer A-1, the upper subbing layer coating composition a-2 described below was applied so as to form a dried layer thickness of 0.1 μm, which was designated Subbing Layer A-2, while onto the Subbing Layer B-1, the upper subbing layer coating composition b-2 was applied so at to form a dried layer thickness of 0.4 μm, having a static preventing function, which was designated Subbing Upper Layer B-2.

Upper Subbing Layer Coating Composition a-2:

| | |
|---|---|
| Gelatin in an amount (weight) to make 0.4 g/m$^2$ | |
| (C-1) | 0.2 g |
| (C-2) | 0.2 g |
| (C-3) | 0.1 g |

-continued

| | |
|---|---|
| Silica particles (av. size 3 μm) | 0.1 g |
| Water to make | 1 liter |
| Upper Subbing Layer Coating Composition b-2: | |
| Sb-doped $SnO_2$ (SNS10M, product of Ishihara Sangyo Co., Ltd.) | 60 g |
| Latex solution (solid 20%, comprising (C-4) as a substituent) | 80 g |
| Ammonium sulfate | 0.5 g |
| (C-5) | 12 g |
| Polyethylene glycol (weight-average molecular weight of 600) | 6 g |
| Water to make | 1 liter |

C-1

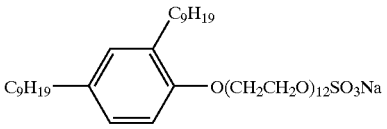

C-2

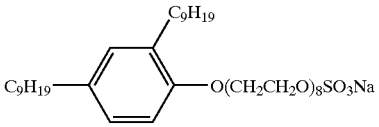

C-3

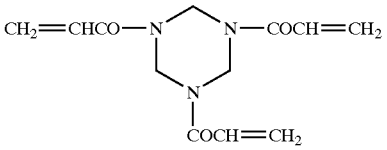

C-4

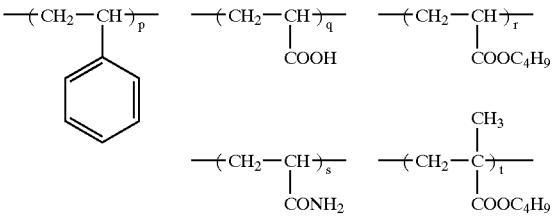

p:q:r:s:t = 40:5:10:5:40 (weight ratio)

C-5

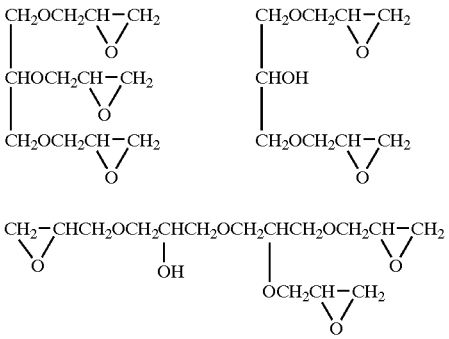

(mixture of the foregoing compounds)

Back Layer Coating Solution:

To 830 g of methyl ethyl ketone (also denoted as MEK), 4.2 g of polyester resin (Vitel PE2200B, available from Bostic Corp.) and 84.2 g of cellulose acetate-butyrate (CAB381-20, available from Eastman Chemical Co.) were added and dissolved. To the resulting solution were added 0.30 g of infrared dye 1, 4.5 g of fluorinated surfactant (Surflon KH40. Asahi Glass Co., Ltd.)) and 2.3 g of fluorinated surfactant (Megafac F120K, Dainippon Ink Co., Ltd.) dissolved in 43.2 g of methanol were added with sufficiently stirring until being dissolved. To the resulting solution, 75 g of silica particles (SILOID 64X6000, W.R. Grace Co.) was added to prepare a coating solution for the back-layer side.

Infrared dye 1

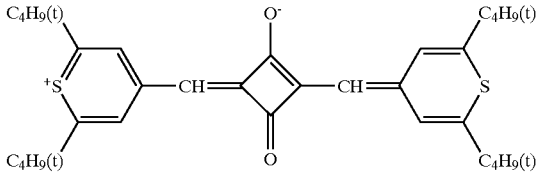

Coating Solution of Protective Back layer:

| | |
|---|---|
| Cellulose acetate butyrate | 15 g |
| Monodisperse silica (monodisperse degree of 15%, average particle size of 8 μm, surface-treated with aluminum of 1% of silica) | 0.030 g |
| $C_8F_{17}(CH_2CH_2O)_{12}C_8F_{17}$ | 0.05 g |
| $C_9F_{17}$—$C_6H_4$—$SO_3Na$ | 0.01 g |
| stearic acid | 0.1 g |
| Oleyl oleate | 0.1 g |
| α-alumina (Mohs' hardness:9) | 0.1 g |

The thus prepared back layer coating solution and protective back layer coating solution were coated on the upper subbing layer so as to form the respective 3.5 μm thick dry layers using an extrusion coater at a coating speed of 50 m/min. Drying was conducted at a dry-bulb temperature of 100° C. and a wet-bulb temperature of 10° C. over a period of 5 min.

| Preparation of Light-sensitive Silver Halide Emulsion A: | |
|---|---|
| Solution A1: | |
| Phenylcarbamoyl gelatin | 88.3 g |
| Compound (1) (10% methanol solution) | 10 ml |
| Potassium bromide | 0.32 g |
| Water to make | 5429 ml |
| Solution B1: | |
| 0.67 M Aqueous silver nitrate solution | 2635 ml |
| Solution C1: | |
| Potassium bromide | 51.55 g |
| Potassium iodide | 1.47 g |
| Water to make | 660 ml |
| Solution D1: | |
| Potassium bromide | 154.9 g |
| Potassium iodide | 4.41 g |
| Iridium chloride | 0.0093 g |
| Potassium ferrocyanate | 0.0081 g |
| Water to make | 1980 ml |
| Solution E1: | |
| 0.4 M aqueous potassium bromide solution | Amount necessary to adjust silver potential |
| Solution F1: | |
| Aqueous 56% acetic acid solution | 16 ml |
| Solution G1: | |
| Anhydrous sodium carbonate | 1.72 g |
| Water to make | 151 ml |
| Compound (1): $HO(CH_2CH_2O)_n$—$(CH(CH_3)CH_2O)_{17}$—$CH_2CH_2O)_mH$ (m + n = 5 to 7) | |

Using a stirring mixer described in JP-B Nos. 58-58288 and 58-58289, ¼ of solution (B1), the total amount of solution (C1) were added to solution (A1) by the double jet addition for 4 min 45 sec. to form nucleus grain, while maintaining a temperature of 45° C. and a pAg of 8.09 using solution (E1). After 7 min, ¾ of solution (B1) and the whole of solution D1 were further added by the double jet addition for 14 min 15 sec., while mainlining a temperature of 45° C. and a pAg of 8.09. The pH of the reaction mixture was 5.6 during mixing. After stirring for 5 min., the reaction mixture was lowered to 40° C. and solution (F1) was added thereto to coagulate the resulting silver halide emulsion. Remaining 2000 ml of precipitates, the supernatant was removed and after adding 10 lit. water with stirring, the silver halide emulsion was again coagulated. Remaining 1500 ml of precipitates, the supernatant was removed and after adding 10 lit. water with stirring, the silver halide emulsion was again coagulated. Remaining 1500 ml of precipitates, the supernatant was removed and solution (G1) was added. The temperature was raised to 60° C. and stirring continued for 120 min. Finally, the pH was adjusted to 5.8 and water was added there to so that the weight per mol of silver was 1161 g, and light-sensitive silver halide emulsion A was thus obtained. It was proved that the resulting emulsion was comprised of monodisperse silver iodobromide cubic grains having an average grain size (equivalent circle diameter) of 0.06 μm, a coefficient of variation of grain size of 12% and a [100] face ratio of 92%.

Preparation of Light-sensitive Silver Halide Emulsion B:

Using a stirring mixer described in JP-B Nos. 58-58288 and 58-58289, ¼ of solution (B1), the total amount of solution (C1) were added to solution (A1) by the double jet addition for 4 min 45 sec. to form nucleus grain, while maintaining a temperature of 24° C. and a pAg of 8.09 using solution (E1). After 7 min, ¾ of solution (B1) and the whole of solution D1were further added by the double jet addition for 14 min 15 sec., while mainlining a temperature of 30° C. and a pAg of 8.09. The pH of the reaction mixture was 5.6 during mixing. After stirring for 5 min., the reaction mixture was lowered to 40° C. and solution (F1) was added thereto to coagulate the resulting silver halide emulsion. Remaining 2000 ml of precipitates, the supernatant was removed and after adding 10 lit. water with stirring, the silver halide emulsion was again coagulated. The subsequent procedure was conducted similarly to the foregoing emulsion A and light-sensitive silver halide emulsion B was thus obtained. It was proved that the resulting emulsion was comprised of monodisperse silver iodobromide cubic grains having an average grain size (equivalent circle diameter) of 0.035 μm, a coefficient of variation of grain size of 10% and a [100] face ratio of 93%.

Preparation of Powdery Organic Silver Salt 1:

Behenic acid of 130.8 g, arachidic acid of 67.7 g, stearic acid of 43.6 g and palmitic acid of 2.3 g were dissolved in 4720 ml of water at 80° C. Then, 540.2 ml of aqueous 1.5 mol/l NaOH was added, and after further adding 6.9 ml of concentrated nitric acid, the mixture was cooled to 55° C. to obtain an organic acid sodium salt solution. To the thus obtained organic acid sodium salt solution, 45.3 g of the light-sensitive silver halide emulsion A obtained above and 450 ml of water were added and stirred for 5 min., while being maintained at 55° C. Subsequently, 702.6 ml of 1M aqueous silver nitrate solution was added in 2 min. and stirring continued further for 10 min. to obtain an organic silver salt dispersion. Then, the thus obtained organic silver salt dispersion was transferred to a washing vessel and deionized water was added thereto with stirring. The dispersion was allowed to stand to cause the organic silver salt dispersion to be subjected to floatation separation, then, the lower aqueous soluble salts were removed. Thereafter, washing with deionized water and draining were repeated until reached to a conductivity of 2 μS/cm. Using a hot air circulation dryer, drying was conducted at 40° C. until run out of reduction of weight to obtain dried powdery organic silver salt 1 exhibiting an average grain size (equivalent circle diameter) of 0.8 μm, an average aspect ratio of 8 and a monodisperse degree of 16%.

Preparation of Powdery Organic Silver Salt 2:

Powdery organic silver salt 2 exhibiting an average grain size (equivalent circle diameter) of 0.7 μm, an average aspect ratio of 6.5 and a monodisperse degree of 14% was prepared similarly to the foregoing organic silver salt 1. except that silver halide emulsion A was replaced by silver halide emulsion B.

Preparation of Powdery Organic Silver Salt 3:

Powdery organic silver salt 3 exhibiting an average grain size (equivalent circle diameter) of 0.4 μm, an average aspect ratio of 5.5 and a monodisperse degree of 12% was prepared similarly to the foregoing organic silver salt 1. except that an aqueous NaOH was replaced by aqueous KOH.

Preparation of Powdery Organic Silver Salt 4:

Powdery organic silver salt 4 exhibiting an average grain size (equivalent circle diameter) of 0.3 μm, an average aspect ratio of 5 and a monodisperse degree of 10% was prepared similarly to the foregoing organic silver salt 3, except that silver halide emulsion A was replaced by silver halide emulsion B.

Preparation of Powdery Organic Silver Salt 5:

Powdery organic silver salt 5 exhibiting an average grain size (equivalent circle diameter) of 1.1 μm, an average aspect ratio of 10 and a monodisperse degree of 21% was prepared similarly to the foregoing organic silver salt 1, except that an aqueous NaOH was replaced by aqueous LiOH.

Preparation of Powdery Organic Silver Salt 6:

Powdery organic silver salt 6 exhibiting an average grain size (equivalent circle diameter) of 1.0 μm, an average aspect ratio of 9.5 and a monodisperse degree of 18% was prepared similarly to the foregoing organic silver salt 5, except that silver halide emulsion A was replaced by silver halide emulsion B.

Preparation of Premix A:

In 1457 g MEK was dissolved 14.57 g of polyvinyl butyral resin (ESLEC BL-5, product of Sekisui Kagaku Co.) and further thereto, 250 g of the foregoing powdery organic silver salt 3 and 250 g of the foregoing powdery organic silver salt 1 were gradually added to obtain preliminarily dispersed mixture, premix A, while stirring by a dissolver type homogenizer (DISPERMAT Type CA-40M, available from VMA-GETZMANN).

Preparation of Premix B to H:

Similarly to the foregoing Premix A, Premix B to H were each prepared according the following combination of powdery organic silver salts:

Premix B: 250 g of silver salt 3 and 250 g of silver salt 2,

Premix C: 250 g of silver salt 3 and 250 g of silver salt 5,

Premix D: 250 g of silver salt 3 and 250 g of silver salt 6,

Premix E: 250 g of silver salt 4 and 250 g of silver salt 1,

Premix F: 250 g of silver salt 4 and 250 g of silver salt 2,

Premix G: 250 g of silver salt 4 and 250 g of silver salt 5.

Premix H: 250 g of silver salt 4 and 250 g of silver salt 6.

Preparation of Premix I:

In 1457 g MEK was dissolved 14.57 g of polyvinyl butyral resin (ESLEC BL-5, product of Sekisui Kagaku Co.) and further thereto, 500 g of the foregoing powdery organic silver salt 1 was gradually added to obtain preliminarily dispersed mixture, premix A, while stirring by a dissolver type homogenizer (DISPERMAT Type CA-40M, available from VMA-GETZMANN).

Preparation of Photo-sensitive Emulsion A:

Thereafter, using a pump, the foregoing premix A was transferred to a media type dispersion machine (DISPERMAT Type SL-C12 EX, available from VMA-GETZMANN), which was packed 0.5 mm Zirconia beads (TORAY-SELAM, available from Toray Co. Ltd.) by 80%, and dispersed at a circumferential speed of 8 m/s and for 10 min. of a retention time with a mill to obtain photosensitive emulsion A.

Preparation of Stabilizer Solution:

In 4.97 g methanol were dissolved 1.0 g of Stabilizer 1 and 0.31 g of potassium acetate to obtain stabilizer solution.

Preparation of Infrared Sensitizing Dye Solution:

In 31.3 ml MEK were dissolved 19.2 mg of infrared sensitizing dye 1, 1.488 g of 2-chlorobenzoic acid, 2.779 g of Stabilizer 2 and 365 mg of 5-methyl-2-mercaptobenzimidazole in a dark room to obtain an infrared sensitizing dye solution.

Preparation of Supersensitizer Solution:

In 8.8 g of methanol was dissolved 50.1 mg of supersensitizer 1 to obtain a supersensitizer solution.

Preparation of Additive Solution (a):

In 110 g MEK were dissolved 27.98 g of reducing agent (A-8), 1.54 g of 4-methylphthalic acid and 0.48 g of infrared dye 1 to obtain additive solution (a).

Preparation of Additive Solution (b):

In 40.9 g MEK were dissolved 3.56 g of antifoggant 2 and 43 g of phthalazine to obtain additive solution (b).

Preparation of Light-sensitive Layer Coating Solution:

A mixture of 50 g of each of the photosensitive emulsion A to I and 15.11 g of MEK were maintained at 21° C. with stirring, and 390 μl of antifoggant 1 (10% methanol solution) was added and stirred for 1 hr. Further thereto, 494 μl of calcium bromide (10% methanol solution) was added and after stirring for 20 min. Subsequently, 2.622 g of infrared sensitizing dye solution was added and stirred for 1 hr. Then, the mixture was cooled to 13° C. and stirred for 30 min. Further thereto, 70 g of the foregoing supersensitizer solution was added and stirred for 5 min., then, 13.31 g of polyvinyl butyral resin (ESLEC BL-5, product of Sekisui Kagaku Co.) was added and stirred for 30 min, while maintaining the temperature at 13° C., and 1.084 g of tetrachlorophthalic acid (9.4% MEK solution) and stirred for 15 min. Then, 12.43 g of additive solution (a), 1.6 ml of 10% MEK solution of Desmodur N3300 (aliphatic isocyanate, product by Movey Co., 10% MEK solution)) and 4.37 g of additive solution (b) were successively added with stirring to obtain light-sensitive layer coating solutions A to I.

Antifoggant 1

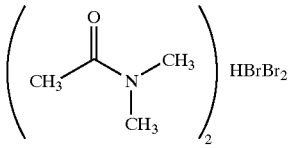

Vinylsulfone (HD-1)

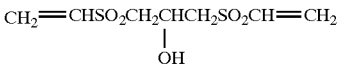

Stabilizer 1

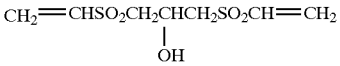

Stabilizer 2

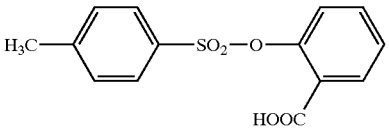

Infrared sensitizing dye 1

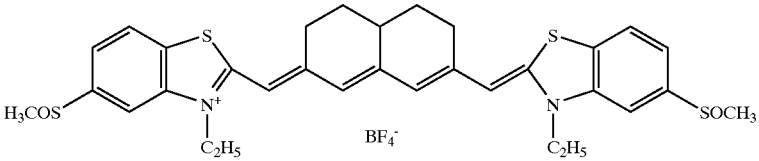

Antifoggant 2

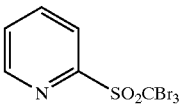

Infrared dye 1

-continued

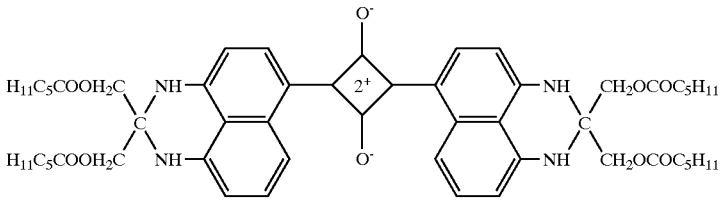

Supersensitizer 1

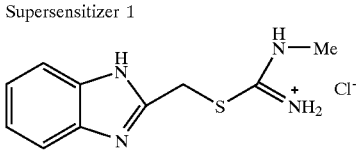

Preparation of Matting Agent Dispersion:

To 42.5 g of MEK, 7.5 g of cellulose acetate-butyrate (CAB171-15, available from Eastman Chemical Co.) was added with stirring. Further thereto, 5 g of Silica particles (SYLOID 320, available from FUJI SYLYSIA Co.) was added and stirred for 30 min. using a dissolver type homogenizer at 8,000 rpm to obtain a matting agent dispersion.

Preparation of Surface Protective Layer Coating Solution

To 865 g of MEK, 96 g of cellulose acetate-butyrate (CAB171-15, available from Eastman Chemical Co.), 4.5 g of polymethyl methacrylate (Paraloid A-21, available from Rohm & Haas Corp.), 1.0 g of benzotriazole, 1.5 g of a vinylsulfone compound (HD-1) and 1.0 g of a fluorinated surfactant (EFTOP EF-105, available from JEMCO Co.) were added. Subsequently, 30 g of the foregoing matting agent dispersion was added thereto to prepare a surface protective layer coating solution.

Preparation of Photothermographic Material Coating of Light-sensitive Layer Side:

The foregoing light-sensitive layer coating solution A and surface protective layer coating solution were controlled to viscosities of 0.228 Pa·s and 0.184 Pa·s, respectively, by adjusting the amount of a solvent and were simultaneously coated on the sublayer A-1 of the support using a commonly known extrusion type coater. After 8 sec., drying was carried out for 5 min with hot air at a dry-bulb temperature of 75° C. and a dew point temperature of 10° C. The thus coated film material was wound up on a roll under an environmental temperature of 23° C., 50% RH and a tension of 196 N/m (20 kg/m) to obtain photothermographic material sample 1-1, in which the silver coverage of the light-sensitive layer was 1.5 g/m$^2$ and the dry thickness of the protective layer was 2.5 $\mu$m. Photothermographic material samples 102 to 109 were prepared similarly the foregoing sample 101, except that the silver coverage was varied as shown in Table 1.

Exposure, Processing and Evaluation:

Samples each were subjected to laser scanning exposure from the emulsion layer side using an exposure apparatus having a light source of 800 nm to 820 nm semiconductor laser of longitudinal multi-mode, which was made by means of high frequency overlapping. In this case, exposure was conducted at an angle of 75°, between the exposed surface and exposing laser light and as a result, images with superior sharpness were unexpectedly obtained, as compared to exposure at an angle of 90°. Subsequently, using an automatic processor provided with a heated drum, exposed samples were subjected to thermal development at a temperature of 110° C. for 15 sec., while bringing the protective layer surface of the photothermographic material into contact with the drum surface. Exposure and thermal development were conducted in an atmosphere at 23° C. and 50% RH.

Processed samples were each subjected to densitometry using a densitometer to prepare a characteristic curve of abscissa-exposure and ordinate-density. Sensitivity (designated S) was defined as the reciprocal of exposure giving a density of 1.0 above a density in the unexposed area (fog density, designated Fog). The sensitivity was represented by a relative value, based on the sensitivity of sample 101 being 100. The maximum density (Dmax), fog density (unexposed area density or minimum density, denoted as Fog) and contrast ($\gamma$) were also determined. Results are shown in Table 1.

The silver coverage (or coating silver weight) was determined by fluorescent X-ray analysis and the covering power (CP) was calculated based on the following equation:

$$\text{Covering power (CP)}=\{(\text{Dmax}-\text{Support Density})/\text{Silver Coverage}\}\times 100$$

wherein Silver Coverage is represented in terms of mg/m$^2$.

TABLE 1

| Sample No. | Photosensitive Emulsion | S | Fog | Dmax | Silver Coverage (g/m$^2$) | CP | $\gamma$ | Remark |
|---|---|---|---|---|---|---|---|---|
| 101 | A | 100 | 0.025 | 3.05 | 1.5 | 192 | 2.8 | Inv. |
| 102 | B | 110 | 0.021 | 3.23 | 1.5 | 204 | 2.6 | Inv. |
| 103 | C | 112 | 0.030 | 3.00 | 1.5 | 189 | 2.6 | Inv. |
| 104 | D | 100 | 0.028 | 3.00 | 1.4 | 202 | 2.5 | Inv. |
| 105 | E | 113 | 0.021 | 3.32 | 1.4 | 225 | 2.7 | Inv. |
| 106 | F | 115 | 0.025 | 3.38 | 1.5 | 214 | 2.8 | Inv. |
| 107 | G | 110 | 0.029 | 3.02 | 1.3 | 219 | 2.4 | Inv. |
| 108 | H | 100 | 0.027 | 3.10 | 1.4 | 209 | 2.7 | Inv. |
| 109 | I | 100 | 0.030 | 3.07 | 1.6 | 181 | 3.3 | Comp. |

As apparent from Table 1, it was proved that photohermographic material samples of this invention exhibited a high covering power, enhanced density and superior gradation.

What is claimed is:

1. A photosensitive emulsion comprising an organic silver salt, a photosensitive silver halide and a dispersing medium, wherein the organic silver salt is comprised of a blend of at least a first organic silver salt grains and a second organic silver salt grains which are different in average grain size from each other, and wherein the first organic silver salt grains have an average grain size of 0.1 to 0.5 μm and the second organic silver salt grains have an average grain size of 0.7 to 1.2 μm.

2. The photosensitive emulsion of claim 1, wherein the first organic silver salt grains account for 10% to 90% by weight of the organic silver salt.

3. The photosensitive emulsion of claim 1, wherein the photosensitive silver halide is comprised of at least a first organic silver salt grains and a second organic silver salt grains which are different in an average grain size from each other.

4. The photosensitive emulsion of claim 3, wherein the first silver halide grains have an average grain size of 0.01 to 0.04 μm, and the second silver halide grains having an average grain size of 0.05 to 0.09 μm.

5. The photosensitive emulsion of claim 3, wherein the first silver halide grains account for 10% to 90% by weight of the silver halide.

6. A photothermographic material comprising a transparent support having thereon a light-sensitive layer containing a photosensitive emulsion as claimed in claim 1, a reducing agent and a binder.

7. The photothermographic material of claim 6, wherein the photothermographic material exhibits a total silver coverage of 0.5 to 1.5 $g/m^2$.

8. The photosensitive emulsion of claim 1, wherein the organic silver salt is a silver salt of a long chain fatty acid having 1 to 30 carbon atoms.

9. The photothermographic material of claim 6, wherein the organic silver salt is a silver salt of a long chain fatty acid having 1 to 30 carbon atoms.

* * * * *